United States Patent [19]

Jackson

[11] 4,022,528

[45] May 10, 1977

[54] ION MODULATOR HAVING INDEPENDENTLY CONTROLLABLE BIAS ELECTRODE

[75] Inventor: Jerome E. Jackson, Shaker Heights, Ohio

[73] Assignee: Addressograph Multigraph Corporation, Cleveland, Ohio

[22] Filed: May 29, 1975

[21] Appl. No.: 581,723

[52] U.S. Cl. ..... 355/3 R; 96/1 R; 346/153

[51] Int. Cl.² ..... G03G 15/00

[58] Field of Search ..... 355/3 SC, 17, 16; 96/1 R, 1 E; 346/74 ES

[56] References Cited

UNITED STATES PATENTS

| | | | |
|---|---|---|---|
| 3,604,925 | 9/1971 | Snelling et al. | 355/3 CH |
| 3,680,954 | 8/1972 | Frank | 355/3 SC |
| 3,786,514 | 1/1974 | Pressman et al. | 355/3 SC |
| 3,867,673 | 2/1975 | Crane et al. | 355/3 SC |

*Primary Examiner*—L. T. Hix
*Assistant Examiner*—J. A. LaBarre
*Attorney, Agent, or Firm*—Michael A. Kondzella; Sol L. Goldstein

[57] ABSTRACT

An ion modulator having a bias electrode which is independently controllable improves the modulation and focusing of projected ions. Such a modulator is constructed so as to reduce the adverse effects of corona discharge upon the modulator.

9 Claims, 7 Drawing Figures

ION MODULATOR HAVING INDEPENDENTLY CONTROLLABLE BIAS ELECTRODE

BACKGROUND OF THE INVENTION

This invention relates to electrophotographic processes and apparatus. In one of its more particular aspects this invention relates to a multilayered ion modulator and its use in improved electrophotographic processes.

Electrophotographic reproduction techniques for making copies of graphic originals using photoconductive media are well known. Such processes generally call for applying a blanket electrostatic charge to a photoconductor in the dark and then exposing the charged photoconductor to a pattern of light and shadow created by directing electromagnetic radiation onto a graphic original. The light-struck areas of the photoconductor are discharged leaving behind a latent electrostatic image corresponding to the original. A developed image is produced by applying an electroscopic powder to the latent electrostatic image and then fixing the image or transferring and fixing onto a suitable receiving medium such as plain paper.

This technique has been extended to foraminated structures which are formed by applying a photoconductive layer to a conductive screen or similar apertured structure. Such structures function as ion modulators selectively passing a stream of ions through the apertures of the screen in a pattern corresponding to the graphic original to be reproduced.

The ion modulators which have been developed heretofore and are known in the prior art fall into several distinct classes:

The first is a simple two-layered screen or grid construction which is formed by applying a photoconductive layer onto an apertured metallic substrate as disclosed in U.S. Pat. No. 3,220,324 to Christopher Snelling. Such a structure can be used to apply to a dielectric target an electrostatic charge corresponding to a pattern of light and shadow created by electromagnetic radiation directed onto a graphic original resulting in the creation of a latent electrostatic image thereon. The majority of the ions are propelled through the areas of the screen which were in a shadow or dark region of the projected image, but some fraction of the ions creating the latent electrostatic image are allowed to pass through the apertures in areas of the modulator corresponding to light or background areas in the original. Copies which are made from electrostatic latent images created in this manner therefore do not generally display the high contrast and low background levels desired.

A second group of photoconductive screens of various constructions has been adapted for use with charged material particles such as charged electroscopic powders. Typical of such screens are those disclosed in U.S. Pat. Nos. 3,694,200 to Gerald L. Pressman and 3,713,734 to Hewitt D. Crane, Gerald L. Pressman and George J. Eilers. Such structures suffer from the deficiency that charged particles accumulate in those areas of structure which attract the particles so that, ultimately, it is required that the screen be cleaned to physically remove the particles in order that the screen may be reused.

The use of such screens with ions rather than charged electroscopic powders is disclosed in U.S. Pat. No. 3,645,614 to Samuel B. McFarlane, Jr., Joseph Burdige and Norman E. Alexander. However the process involved in the use of these screens requires a multiplicity of steps and results in a reversal image.

While the prior art modulators have advanced the electrophotographic art, there are disadvantages which need to be overcome in order to provide an ion modulator system which can be operated so that copies of high quality can be made.

OBJECTS

It is accordingly an object of this invention to provide improved electrophotographic apparatus and processes.

It is another object of this invention to provide improved ion modulators which are capable of being operated to produce copies of high quality.

Another object of this invention is to provide an ion modulator in which the adverse effects of degradation due to corona discharge are minimized.

Other objects and advantages of this invention will become apparent in the course of the following detailed disclosure and description.

SUMMARY OF THE INVENTION

The ion modulator of this invention consists of a conductive screen or grid coated on one side with a photoconductive material upon which is coated an insulating material, and coated on the other side with an insulating material, which may or may not be photoconductive upon which is deposited a conductive electrode which functions as a bias electrode.

As is known, the modulator device is positioned between a source of ions and a collecting plate. The ions are propelled toward the modulator due to external electric fields and near the vicinity of the modulator apertures experience additional fields due to charge distributions on the modulator that either prevent or assist the passage of the ions through the apertures.

In the process of this invention the modulator is charged or sensitized by means of a corona discharge from the insulator side of the modulator with a bias potential applied between the screen and bias electrode of the same polarity as that of the sensitizing corona. Applying a bias potential in this manner increases the charge acceptance of the modulator. Without the applied bias a higher charge acceptance could only be achieved by extending the coating of the photoconductor to the side of the screen facing away from the sensitizing corona which created fabrication problems and increased the likelihood of photoconductor degradation.

THE DRAWING

DESCRIPTION OF THE PREFERRED EMBODIMENTS

Figure 1:
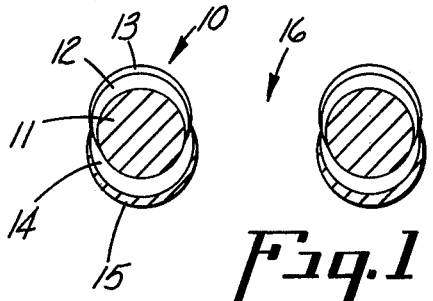
FIG. 1 is a diagrammatic cross-sectional view of one embodiment of a portion of an ion modulator according to this invention.

Referring to FIG. 1 there is shown in cross-section a diagrammatic view of an ion modulator according to one embodiment of this invention. The modulator 10 consists of conductor 11 coated on one side with photoconductor 12 over which is coated insulator 13. On the other side conductor 11 is coated with insulator 14. Deposited upon insulator 14 is conductor 15 which functions as a bias electrode. The apertures in the ion modulator are generally indicated by the numeral 16.

Conductor 11 can be a nickel, copper, brass, aluminum or stainless steel screen which is produced by electroforming or can be a metallic grid produced by means of photochemical machining. Conductor 11 can also be any other conductive material produced by any conventional method of producing an apertured configuration such as a wire cloth material, as long as it forms a junction with the photoconductor that is blocking to one polarity of charge. Conductor 11 may be any convenient size but is preferably in the range of 10 to 50 microns in thickness. For example, a 200 mesh wire screen in which the wire diameter is 50 microns and the average aperture size is about 74 microns can be used.

Photoconductor 12 is preferably from about 3 microns to 20 microns in thickness and may be selected from a wide variety of known photoconductors including inorganic and organic materials. Selenium, zinc oxide, and cadmium sulfide are representative of satisfactory inorganic materials. Various organic polymeric photoconductors such as polyvinylcarbazole, the polyvinylbenzocarbazoles described in U.S. Pat. No. 3,751,246 to Helen C. Printy and Evan S. Baltazzi and polyvinyliodobenzocarbazoles described in U.S. Pat. No. 3,764,316 to Earl E. Dailey, Jerry Barton, Ralph L. Minnis and Evan S. Baltazzi are also satisfactory photoconductors. Other organic photoconductors which can be used include monomeric photoconductors which require dispersion in a suitable vehicle, for example, in a resin binder. These photoconductors include the benzofluorenes and dibenzofluorenes described in U.S. Pat. No. 3,615,412 to William J. Hessel and the cumulenes described in U.S. Pat. No. 3,674,473 to Robert G. Blanchette, all assigned to the same assignee as this invention. In many instances organic photoconductors, both polymeric and monomeric, can be used with a suitable sensitizer to extend the spectral range of the photoconductor. For example, dyes can be used for this purpose. Another class of materials which are widely used are the pi-acids. Representative of these compounds are the oxazolone and butenolide derivatives of fluorenone described in U.S. Pat. No. 3,556,785 to Evan S. Baltazzi, the dicyanomethylene substituted fluorenes described in U.S. Pat. No. 3,752,668 to Evan S. Baltazzi, and the bianthrones described in U.S. Pat. No. 3,615,411 to William J. Hessel, all assigned to the same assignee as this invention.

Thus, any standard photoconductive composition suitable in xerographic applications can be used as a coating in fabricating the ion modulator of this invention.

Any insulating material, organic or inorganic, can be used as insulator 13 or insulator 14. Polymeric insulating compositions such as a vinyl resin, for example, polystyrene, a polypropylene or an acrylic resin; a polyester such as a polycarbonate or polyterephthalate; an epoxy resin or a silicone are suitable. In organic insulating materials which can be used for this purpose include silicon dioxide, silicon nitride and boron nitride. Insulator 13 and insulator 14 can be deposited upon photoconductor 12 or conductor 11 by means of any suitable coating techniques such as by sputtering an inorganic insulating material upon the surface of the conductive or insulating substrate or spraying thereon a suitable organic polymer and can be applied to provide a thickness of about from 2 to 20 microns; preferably, about from 5 to 10 microns.

Insulators which have low charge decay rates are preferred. The insulator should also be inert to degradation caused by corona discharge. Polystyrene, polyesters and polydiphenylsiloxane have been found to meet these requirements and are accordingly preferred.

Insulator 13 and insulator 14 may be the same material or they may be different as desired. Either photoconductor 12 or insulator 14 may be applied to conductor 11 of the screen first as desired followed by the application of either conductor 15 or insulator 13.

Conductor 15 serving as a bias electrode can be of the same material as conductor 11. Vacuum deposition of aluminum or other conductive metals results in an electrode having the property desired and is therefore preferred. Other methods of depositing a conductive layer as described with reference to conductor 11 are also satisfactory. The thickness of conductor 15 can be varied from about 0.1 micron to 2 microns.

Figure 2:
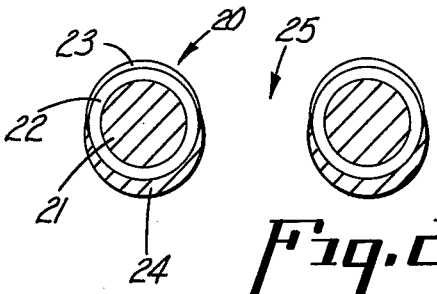
FIG. 2 is a diagrammatic cross-sectional view of another embodiment.

If desired, rather than coating a photoconductive material on one side of the screen and an insulating material which is not photoconductive on the other side thereof, a photoconductor can be coated on all sides of the screen in order to simplify the coating operation. This embodiment is illustrated in FIG. 2 wherein modulator 20 consists of conductor 21 coated on all sides with photoconductor 22 and having insulator 23 coated upon one side of photoconductor 22 and conductor 24 deposited upon the other side thereof. Apertures in the ion modulator are generally indicated by the numeral 25.

Figure 3:
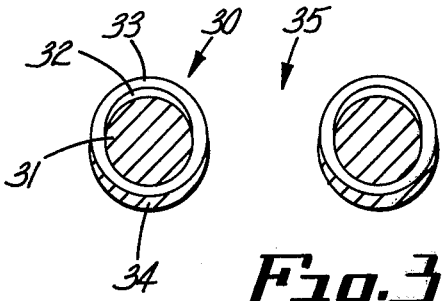
FIG. 3 is a diagrammatic cross-sectional view of another embodiment.

FIG. 3 shows another construction of the ion modulator of this invention wherein modulator 30 consists of conductor 31 coated on one side with photoconductor 32. Insulator 33 surrounds conductor 31 and photoconductor 32 on all sides. On one side of insulator 33 is deposited conductor 34 which acts as a bias electrode. Apertures in the ion modulator are indicated by the numeral 35.

Figure 4:
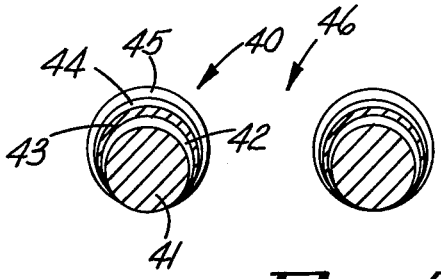
FIG. 4 is a diagrammatic cross-sectional view of another embodiment.

FIG. 4 shows yet another construction in which modulator 40 consists of conductor 41 which is partially overcoated with insulator or photoconductor 42 upon which is deposited conductor 43 which acts as a bias electrode. Photoconductor 44 overlies conductor 43 and is overcoated with insulator 45. Apertures in the ion modulator are indicated by the numeral 46.

Figure 5:
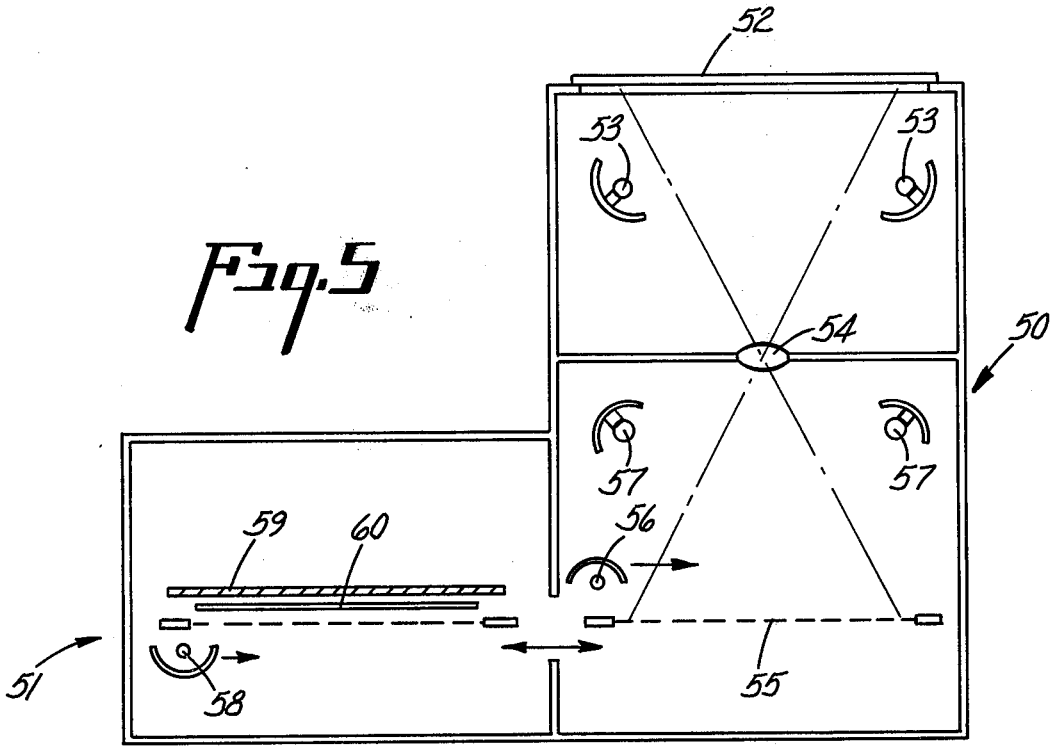
FIG. 5 is a diagrammatic view partly in cross-section of an apparatus suitable for use in this invention.

Apparatus suitable for use with the ion modulator of this invention is shown in FIG. 5. The apparatus generally consists of imaging chamber 50 and projection chamber 51. Original 52 to be copied is imaged in imaging chamber 50 by means of lamps 53 and lens 54 upon ion modulator 55 which can be charged by means of charging corona 56 or blanketed with light by means of flood lights 57 as required in the various process steps detailed hereinafter.

Ion modulator 55 is then moved into projection chamber 51 where an ion stream from projection corona 58 is caused to impinge thereon.

In this position ion modulator 55 is backed up by high voltage plate 59. Dielectric surface 60 interposed between ion modulator 55 and high voltage plate 59 receives a charge pattern corresponding to the ions transmitted through ion modulator 55 as will be explained in detail below.

Figure 6:
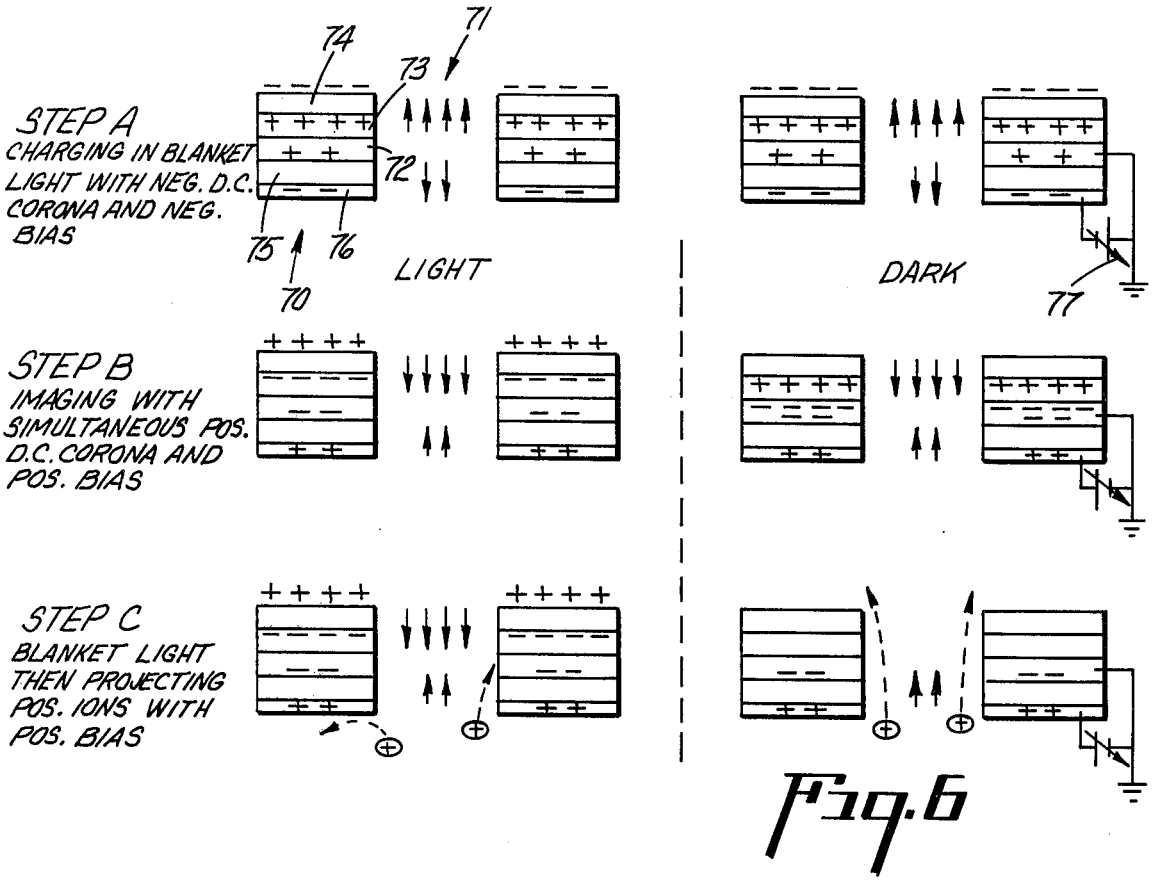
FIG. 6 is a diagrammatic view of the steps involved in a process for producing a latent electrostatic image using the ion modulator of this invention.

FIG. 6 shows the steps involved in one process for using the ion modulator of this invention to produce a latent electrostatic image upon a dielectric surface. Ion modulator 70 having apertures 71 consists of conductor 72 having on one side thereof photoconductive layer 73 and non-photoconductive insulating layer 74. On the other side of conductor 72 there is an insulating layer 75 which, as pointed out above, may be photoconductive or non-photoconductive as desired and bias electrode 76.

The process steps which result in producing a latent electrostatic image upon a dielectric surface such as dielectric paper using the ion modulators of this invention include the following: first, charging or sensitizing the ion modulator in blanket light by means of a negative DC corona with a negative bias imposed upon the ion modulator; second, imaging with simultaneous exposure to a positive DC corona with a positive bias imposed; third, projecting positive ions with a positive bias imposed after flooding the modulator with blanket light. A latent electrostatic image is thereby created upon a dielectric surface in the path of the ions transmitted through the ion modulator. Toning and transfer, if desired, may be accomplished in the conventional manner.

As shown in Step A of FIG. 6, the first step results in a charge being built up around non-photoconductive insulating layer 74 in which the polarity is negative on the outside surface of layer 74, that is, the top surface which has been exposed to a negative DC corona. The negative bias potential applied to modulator 70 by means of battery 77 results in a charge across insulating layer 75. As shown diagrammatically in FIG. 6, dipole fields are produced within the apertures 71 of ion modulator 70.

Upon reversing the polarity of the bias potential applied to ion modulator 70 by means of bias electrode 76 and imaging while applying a positive DC corona the charge distribution in the various layers of ion modulator 70 is changed as shown in Step B. The reversal of bias polarity results in dipoles of a polarity opposite to that in Step A across insulating layer 75 in both light and dark areas, that is, areas corresponding to background and image areas in the original. In the light areas dipoles of a polarity opposite to that in Step A are created across insulating layer 74. In the dark areas, since the positive charges are trapped within photoconductive layer 73, dipoles are created across photoconductive layer 73. These dipoles have a polarity opposite to that of the dipoles across insulating layer 74 in Step A.

In Step C blanket light discharges photoconductor 73 in the dark areas resulting in the charge distribution and dipole fields shown.

Positive ions projected from below ion modulator 70, that is, from the side facing bias electrode 76, will be repelled from the apertures 71 in the light areas of the modulator and accelerated through the apertures in the dark areas thereof as shown diagrammatically in Step C of FIG. 6, resulting in the formation of a latent electrostatic image corresponding to the original upon a dielectric surface placed in the ion path.

The process thus described operates in the positive mode, that is, a positive copy is produced from a positive original. In order to produce a positive copy from a negative original or a negative copy from a positive original by operating the ion modulator of this invention in the negative mode it is necessary to reverse the polarities throughout the process except for the polarity of the projected ions. Such a process is illustrated in FIG. 7.

In Step A a positive DC corona is used to charge the modulator in blanket light with a positive bias imposed.

Figure 7:
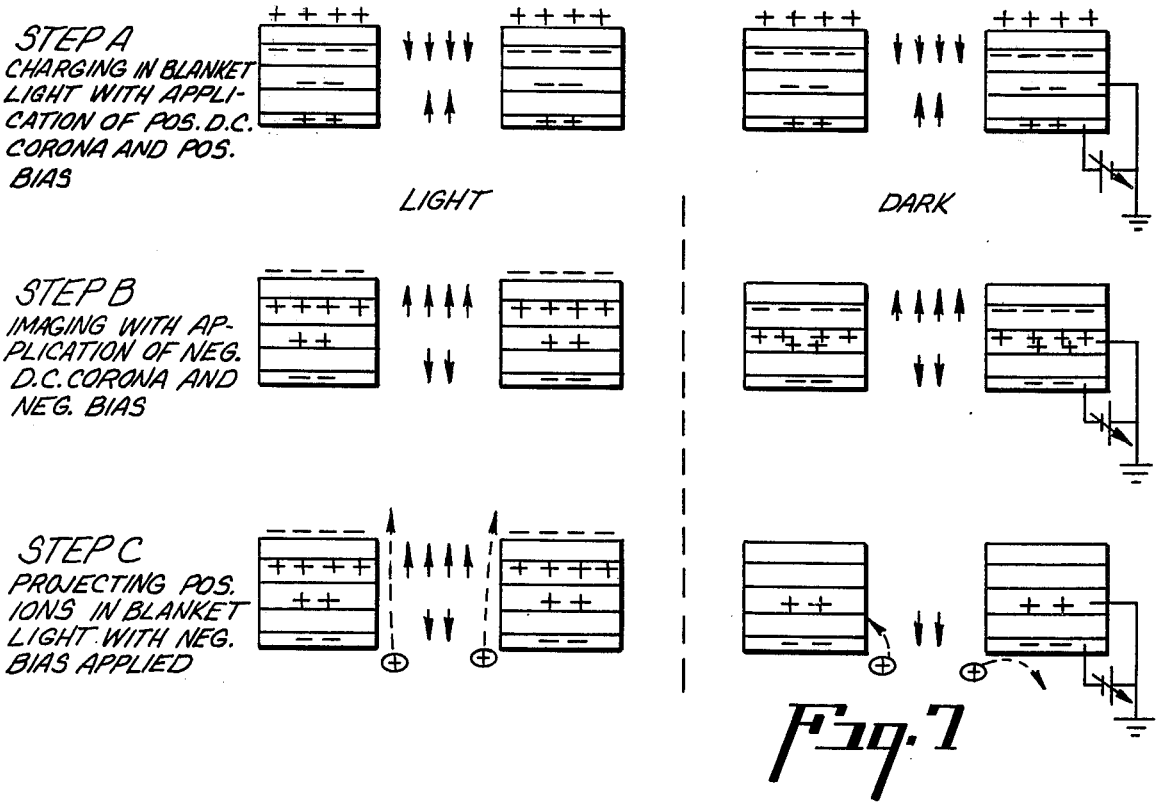
FIG. 7 is a diagrammatic view of the steps involved in another such process.

In Step B a negative DC corona redistributes the charge as shown in FIG. 7. A negative bias is imposed.

In Step C the projection of positive ions in blanket light with imposition of a negative bias results in ions being transmitted through apertures in areas of the modulator corresponding to background areas in the original. The latent electrostatic image produced upon a dielectric surface in the path of the transmitted ions in therefore in the opposite sense to that of the original, that is, negative if the original were positive or positive if the original were negative.

It should be appreciated that negative ions can be projected as well so long as appropriate polarity changes are made depending on the type of process desired.

Although the invention has been illustrated by reference to the modulator configuration of FIG. 1, any of the modulator configurations of this invention can be used with the attainment of similar results.

The bias applied to bias electrode 76 during charging, imaging and projecting may be a potential in the range of about from 25 volts to 100 volts. The corona used for charging or sensitizing the modulator may have a potential in the range of about from 4,000 volts to 12,000 volts. The corona used for producing the stream of ions which is projected upon ion modulator 70 can be produced using a potential in the range of about from 4,000 volts to 12,000 volts. The potential applied to high voltage plate 59 may be from about 2,000 volts to 10,000 volts depending upon spacing.

Varying the bias potential permits operation of the ion modulators of this invention in a manner such that background can be eliminated by effectively shifting the ion transmission curve, a plot of ion transmission against modulator potential, to a point where the transmission in areas corresponding to background in the original is insufficient to produce any image upon subsequent development in the case of a process operating in the positive mode to produce a positive copy from a positive original.

The construction of the modulators of this invention ensures long life by minimizing the adverse effects of degradation due to corona discharge during the projection of ions upon the modulator. In the embodiments of FIGS. 1, 2 and 3, the bias electrode faces the projected ions. In the embodiment of FIG. 4 the uncoated side of the screen protects the insulating layers from ion bombardment. The effect is more pronounced when negative ions are projected since degradation of most insulating surfaces is more rapid in the case of negative ions than positive ions.

This invention has been described with reference to certain specific embodiments and to various suggested conditions of operation. However, other embodiments can be utilized in the practice of this invention. It is therefore intended that this invention is not to be limited except as defined in the following claims.

I claim:

1. An ion modulator comprising a conductive screen, a thin metal film, an electrically insulating layer interposed between said screen and said film, a photoconductive layer overcoating one of said screen and said film and an electrically insulating non-photoconductive layer overcoating said photoconductive layer.

2. An ion modulator according to claim 1 wherein said electrically insulating layer is photoconductive.

3. An ion modulator selected from the group consisting of a. a conductive screen having a photoconductor coated on one side thereof, an electrically insulating layer coated on the other side thereof, a thin metal film applied to said electrically insulating layer and an electrically insulating non-photoconductive layer applied to said photoconductor;

b. a conductive screen overcoated with a photoconductive layer, said photoconductive layer being coated on one side thereof with a thin metal film and on the other side thereof with an electrically insulating non-photoconductive layer;

c. a conductive screen having an electrically insulating layer partially coated thereon, a thin metal film coated only on said electrically insulating layer, a photoconductive layer coated only on said metal film and an electrically insulating non-photoconductive layer coated only on said photoconductive layer and d. a conductive screen having a photoconductive layer partially coated thereon, an electrically insulatng non-photoconductive layer coated over said photoconductive layer and the portion of said screen not coated with said photoconductive layer and a thin metal film coated only upon the portion of said electrically insulating non-photoconductive layer overlying that portion of said screen not coated with said photoconductive layer.

4. An ion modulator according to claim 3 wherein said electrically insulating layer is photoconductive.

5. A process for producing copies of a graphic original comprising the steps of:

1. applying an electrostatic charge to an ion modulator in blanket light while applying a bias potential of the same polarity as said electrostatic charge,
2. projecting upon said ion modulator a pattern of light and shadow corresponding to said graphic original while applying a DC corona of a polarity opposite to that of said electrostatic charge and a bias potential of the same polarity as said DC corona,
3. flooding said ion modulator with blanket light,
4. projecting ions of the opposite polarity to that of said electrostatic charge while applying a bias potential of the same polarity as that of said ions, whereby ions are transmitted through said ion modulator in a pattern corresponding to said original,
5. creating a latent electrostatic image corresponding to said pattern upon a dielectric surface in the path of said transmitted ions, and
6. developing said latent electrostatic image, said ion modulator comprising a conductive screen, a thin metal film, an electrically insulating layer interposed between said screeen and said film, a photoconductive layer overcoating one of said screen and said film and an electrically insulating non-photoconductive layer overcoating said photoconductive layer.

6. A process according to claim 5 wherein said electrostatic charge is of negative polarity, said ions are of positive polarity and the process operates in the positive mode.

7. A process according to claim 5 wherein said electrically insulating layer is photoconductive.

8. A process according to claim 5 wherein said ion modulator is a member selected from the group consisting of a. a conductive screen having a photoconductor coated on one side thereof, an electrically insulatng layer coated on the other side thereof, a thin metal film applied to said electrically insulating layer and an electrically insulating non-photoconductive layer applied to said photoconductor;

b. a conductive screen overcoated with a photoconductive layer, said photoconductive layer being coated on one side thereof with a thin metal film and on the other side thereof with an electrically insulating non-photoconductive layer;

c. a conductive screen having an electrically insulating layer partially coated thereon, a thin metal film coated only on said electrically insulating layer, a photoconductive layer coated only on said metal film and an electrically insulating non-photoconductive layer coated only on said photoconductive layer and d. a conductive screen having a photoconductive layer partially coated thereon, an electrically insulating non-photoconductive layer coated over said photoconductive layer and the portion of said screen not coated with said photoconductive layer and a thin metal film coated only upon the portion of said electrically insulatng non-photoconductive layer overlying that portion of said screen not coated with said photoconductive layer.

9. A process for producing copies of graphic original comprising of steps of:

1. applying an electrostatic charge to an ion modulator in blanket light while applying a bias potential of the same polarity as said electrostatic charge;
2. projecting upon said ion modulator a pattern of light and shadow corresponding to said graphic original while applying a DC corona of a polarity opposite to that of said electrostatic charge and a bias potential of the same polarity of said DC corona;
3. flooding said ion modulator with blanket light;
4. projecting ions of the same polarity as that of said electrostatic charge while applying a bias potential of the opposite polarity to that of said ions, whereby ions are transmitted through said ion modulator in a pattern corresponding to said original;
5. creating a latent electrostatic image corresponding to said pattern upon a dielectric surface in the path of said transmitted ions; and
6. developing said latent electrostatic image, said ion modulator comprising a conductive screen, a thin metal film, an electrically insulating layer interposed between said screen and said film, a photoconductive layer overcoating one of said screen and said film and an electrically insulating non-photoconductive layer overcoating said photoconductive layer.

* * * * *